US007234190B2

(12) United States Patent
McEntyre et al.

(10) Patent No.: US 7,234,190 B2
(45) Date of Patent: Jun. 26, 2007

(54) ULTIMATE BRUSH

(75) Inventors: Sally Marie McEntyre, Baldwin, GA (US); Rick McEntyre, 109 Bradley Dr., Baldwin, GA (US) 30511

(73) Assignees: Rick McEntyre, Baldwin, GA (US); Sally McEntyre, Baldwin, GA (US)

( * ) Notice: Subject to any disclaimer, the term of this patent is extended or adjusted under 35 U.S.C. 154(b) by 0 days.

(21) Appl. No.: 11/007,608

(22) Filed: Dec. 8, 2004

(65) Prior Publication Data

US 2005/0102782 A1 May 19, 2005

Related U.S. Application Data

(63) Continuation-in-part of application No. 10/189,407, filed on Aug. 30, 2002, now Pat. No. 6,915,543.

(60) Provisional application No. 60/329,179, filed on Oct. 15, 2001.

(51) Int. Cl.
*A46B 5/00* (2006.01)
*A46B 9/02* (2006.01)

(52) U.S. Cl. ..... 15/160; 15/186; 132/120; D4/128

(58) Field of Classification Search ..... 15/159.1, 15/160, 164, 168, 186, 187, 206; 132/120; D4/127, 128, 130–134, 136
See application file for complete search history.

(56) References Cited

U.S. PATENT DOCUMENTS

| | | | | | |
|---|---|---|---|---|---|
| 582,190 | A | * | 5/1897 | Eastman | 15/27 |
| 1,967,597 | A | * | 7/1934 | Schwartz | 15/206 |
| 2,228,067 | A | * | 1/1941 | Von Den Driesch | 15/164 |
| 4,030,158 | A | * | 6/1977 | Blair et al. | 15/207.2 |
| 4,167,192 | A | * | 9/1979 | Arnold | 132/212 |
| D366,153 | S | * | 1/1996 | Stoller | D4/128 |
| D467,737 | S | * | 12/2002 | Park | D4/128 |

FOREIGN PATENT DOCUMENTS

| | | | |
|---|---|---|---|
| DE | 19924598 | * | 11/2000 |
| EP | 233304 | * | 8/1987 |
| JP | 7-236518 | * | 9/1995 |
| JP | 11-103934 | * | 4/1999 |
| WO | 89/04619 | * | 6/1989 |

* cited by examiner

*Primary Examiner*—Mark Spisich

(57) ABSTRACT

This new and improved cone hair care brush is provided which enables multiple curls of varying diameters within each lock of hair. Also, the cone hairbrush allows for a root lifter to achieve more body to the overall look of the hair by applying the smallest end of the cone brushhead invention to the scalp while lifting and blow drying the hair simultaneously. The cone brushhead may include ventilation holes that would allow the hair to blow dry much faster.

1 Claim, 4 Drawing Sheets

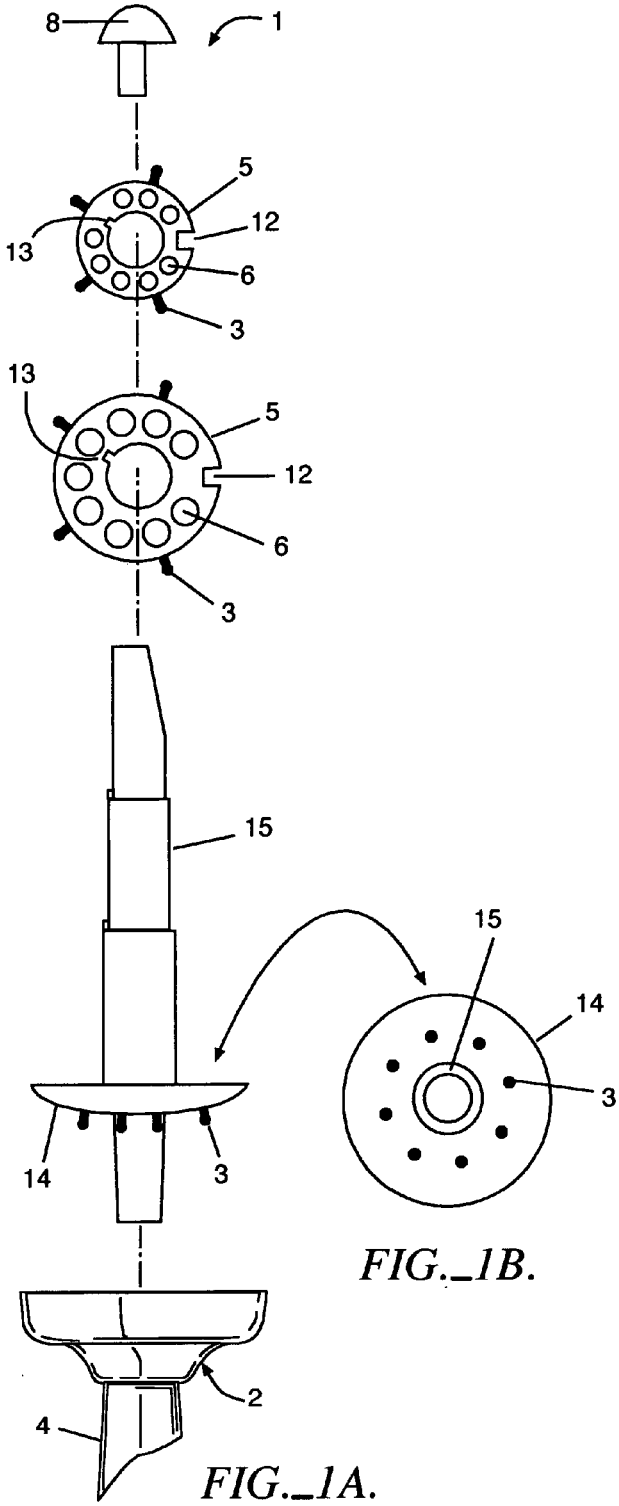
FIG._1A.
FIG._1B.
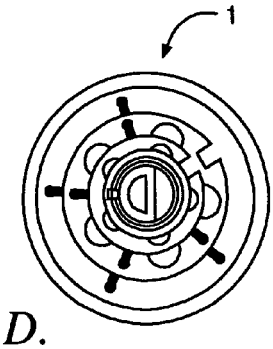
FIG._1D.
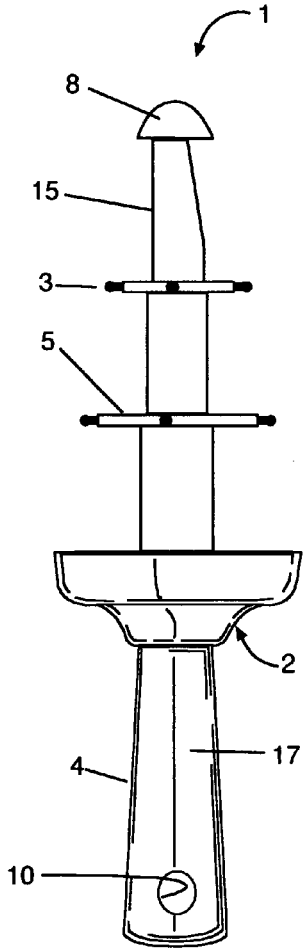
FIG._1C.

ULTIMATE BRUSH

RELATED APPLICATIONS

This application is a continuation-in-part of application Ser. No. 10/189,407, filed Aug. 30, 2002, now U.S. Pat. No. 6,915,543, which claims benefit of provisional application 60/329,179, filed Oct. 15, 2001.

FIELD OF THE INVENTION

The present invention concerns a device for acquiring a multiplicity of hair curl diameters, pinpoint root lifting and hairstyles, in particular a cone shaped brush head that allows for a range of small to large curls.

DESCRIPTION OF THE PRIOR ART

It is known that persons with straight hair wish to temporarily curl and style their hair through techniques such as blow-drying damp hair with hot air and a brush. It is common to gently wind a plurality of strands of hair on a cylindrical brush head in an effort to curl the hair; however, the curl developed by a typical cylindrical brush head is limited to the constraints of a constant diameter. Also, cylindrical brush heads are cumbersome and hardly achieve a pinpoint root lifter for the hair. Small cylindrical heads produce small helixes and large cylindrical heads produce large helixes.

It is thereof an object of the present invention to surpass the disadvantages associated with conventional hairbrushes, and to provide a plurality of curl diameters and pinpoint root lifter for styling hair into shaped that cannot be achieved using conventional brushes.

SUMMARY OF THE INVENTION

The brush of the present invention is a convenient, economical and new development in the hair care industry. Very stylish and innovative while achieving multiple curl sizes and a root lifter with the use of only one brush.

The present invention aims an improved method and device for acquiring a multiplicity of diameters and pinpoint root lifter to achieve more body to the hair at the root which is new and which moreover offers several advantages.

To this end, the invention aims a method for achieving a plurality of curl diameters, whereby curls are formed once a damp section of hair is wound gently around the cone brush head and onto a pre-selected diameter, which is provided with the cone shaped brush head accompanied by a hot-air blow dryer for rapid results in setting the curl.

As the small end of the brush head makes contact with the root, gently pulling the towel dried hair through the bristles, this offers the advantage that one does need to achieve a select and isolated root lifter to achieve more body for the specified lock of hair accompanied by a hot-air blow dryer for rapid results.

Also according to the invention, the time-consuming intermediate treatment of changing from one cylindrical brush head to another, which is necessary in known embodiments in order to allow the hair to be quickly set into the various-diameter helix, is excluded.

Another ensuing advantage consists in that the cone shape brush head obtains a variety of diameters along its length, which provides convenient, quick and easy curl sizes.

Additional objects and advantages of the various aspects of the present invention will become apparent from the following description of the preferred embodiment in conjunction with the accompanying drawings.

BRIEF DESCRIPTION OF THE DRAWINGS

FIG. 1A illustrates an exploded side view embodiment of a hot-air brush with an improved cone brush head 1 of the present invention;

FIG. 1B illustrates a bottom end view embodiment of the improved cone brush head 1 of the present invention;

FIG. 1C illustrates an exploded side view embodiment of the cone brush head 1 with elements placed in engaged position of the present invention;

FIG. 1D illustrates an exploded top end view embodiment of the cone brush head 1 of the present invention;

DETAILED DESCRIPTION OF THE PREFERRED EMBODIMENT

Figure 2B:
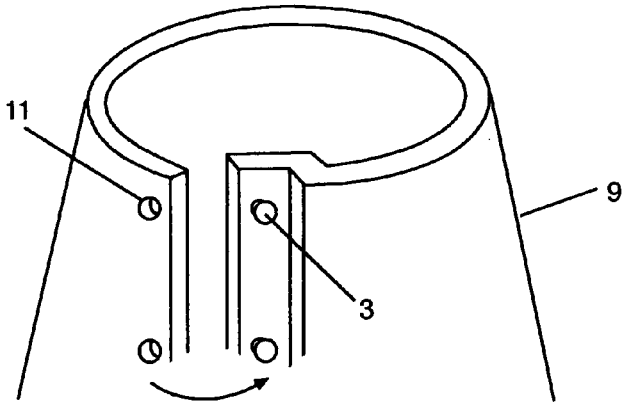
FIG. 2B illustrates a close up top view of embodiment of the cone brush head 1 of the present invention.
Figure 2C:
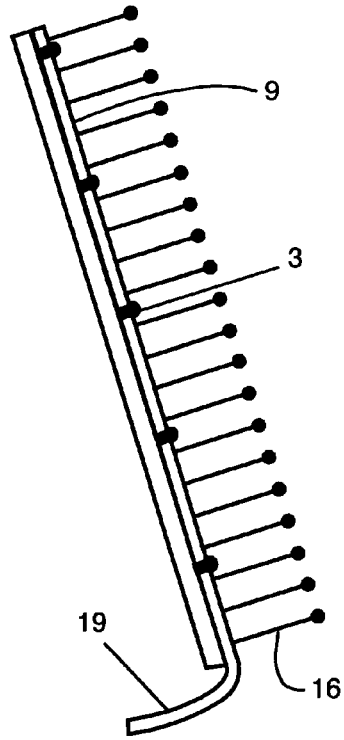
FIG. 2C illustrates a side view embodiment of the cone brush head 1 of the present invention.
Figure 2A:
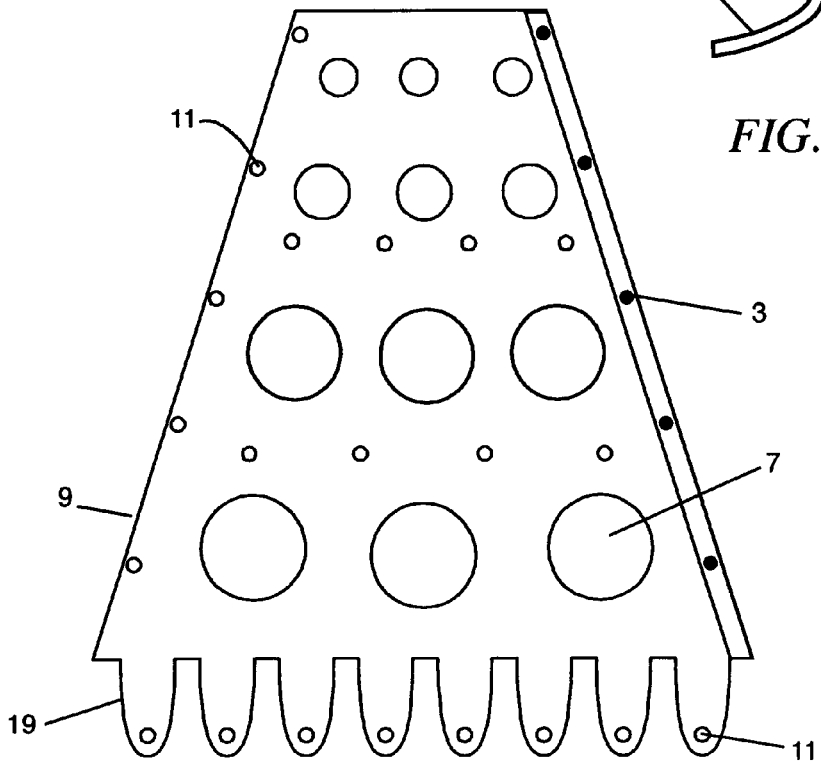
FIG. 2A illustrates an outside view of the flat panel of bristles 9 embodiment of the cone brush head 1 of the present invention.

With general reference to the drawings a cone brush head for styling hair is identified at reference numeral 1 and includes a rigid body 2 ideally molded from plastic material.

FIGS. 1A-4B illustrate one embodiment of the one brush head 1 of the present invention. With initial reference to FIG. 4A is a side view of a cone brush head. Brush 1 of the present invention is illustrated to generally include a main body 2 having a handle portion 4 and a head portion 9. FIG. 1B illustrates a bottom end view of a docking station 14 embodiment molded to a cylindrical tube 15 of the cone brush head 1 of the present invention. FIG. 1C illustrates an exploded side view of the cone brush head 1 with exploded side view elements engaged. FIGS. 2A, 2B and 2C illustrate a side view embodiment with and without a portion of the bristles 16 to better define the details on the invention 1. FIG. 2B illustrates the plastic hollow cavity 9 excluding the bristles 16. FIG. 2A illustrates an additional exploded side view of the brush head element 1 that includes the plastic material 9 in a flat form excluding the bristles 16.

The main body 1 is ideally made of plastic material. The handle portion 4 is generally cylindrical in shape. A distal end 17 of the handle portion 4 includes an aperture 10 so that the brush 1 can be hung from a peg.

The head portion 18 of the brush 1 is specifically cone in shape and formed into a thin plastic material with a cone shaped hollow cavity 18 along its length and has defined thereon a number of holes 7. These holes includes circular holes that allow the air from the hot-air brush to pass through the cone brush head 1, thereby aiding in the drying and shaping of the hair. Additionally, the air holes includes circular holes 11 that allow the docking stations 3 to engage with the flat plastic panel 9 containing a plurality of bristles 16 protruding from the outer surface 9 of the cone brush head 1.

Figure 3:
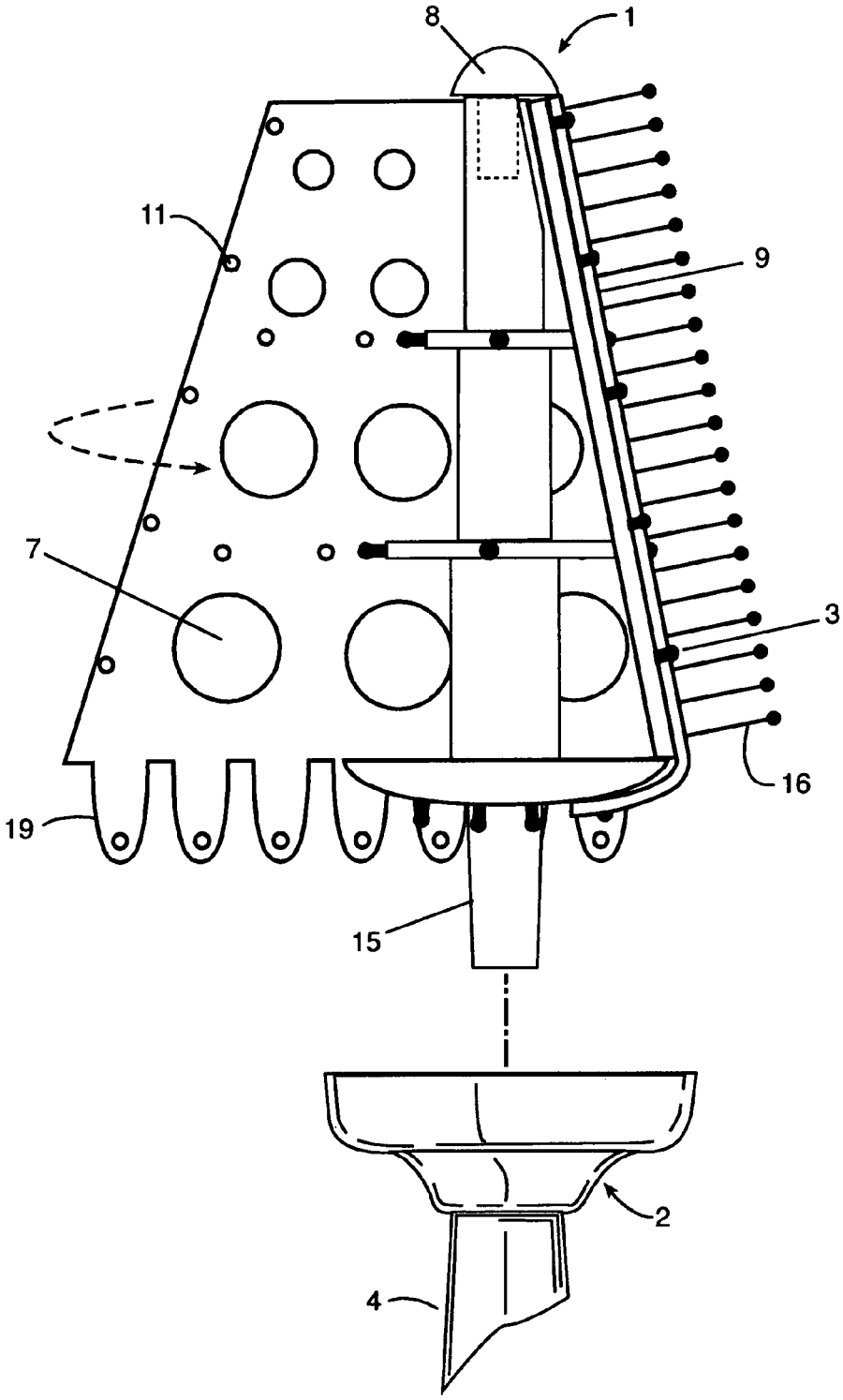
FIG. 3 illustrates an exploded side view embodiment of the cone brush head 1 including a flat panel with bristles 9 of the present invention.
Figure 4A:
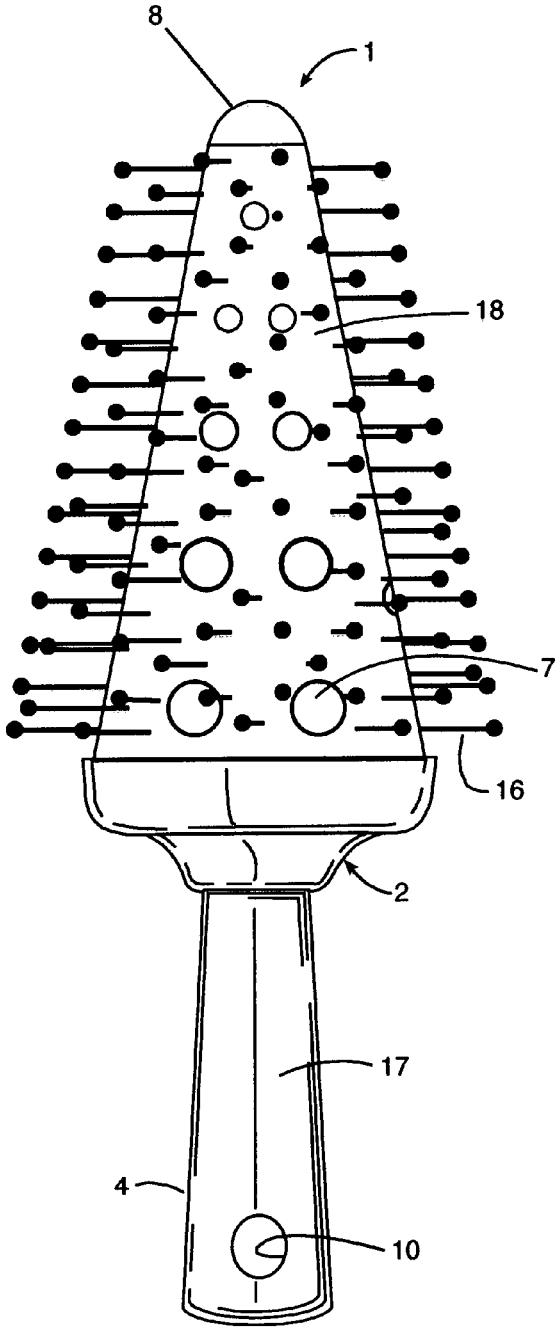
FIGS. 4A and 4B illustrates an embodiment of the cone brush head 1 and optional retainer cap 8 of the present invention.
Figure 4B:
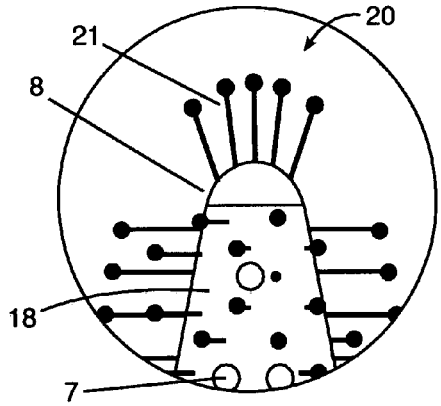

With particular reference to FIGS. 2A-4A, the bristles element 16 of the brush 1 of the present invention is constructed in a conventional manner to include a rigid elongated hollow cylindrical tube 15. The plastic cylindrical tube 15 is engaged to additional docking stations located around the outside edge of each stationary disk 5 which also aid in basic support and stabilization of the cone brush head 1. Each stationary disk 5 has a defined number of air holes 6 which encircle each stationary disk 5. Each stationary disk 5 contains a docking mortise 13. Additionally, each stationary disk 5 contains a mortise support groove 12. The flat plastic panel 9 has a defined number of holes 7 that aide in the drying process. Additionally, the flat plastic panel 9 has a defined number of smaller holes 11 that engage in the capture of a plurality of protruding nibs 3 which form and stabilize the cone brush head 1 portion. A retainer cap 8, preferably made of plastic material, is located at the vertex top end view of the cone brush head 1. FIG. 3 illustrates an exploded side view of the cone brush head 1. The fit plastic panel 9 contains a plurality of flaps 19, each flap 19 contains a small hole 11 that aides I the capture of the plurality of nibs 3. FIG. 4B illustrates an alternate embodiment of the cone brush head 20 of the present invention. FIG. 4B illustrates a side view of hair brush 20. As shown in FIG. 4B, hair brush 20 includes a handle, a cone brush head 18, and bristles 21. In the embodiment shown in FIG. 4B, the cone brush head 20 is hollow and has a defined number of holes 7 that aide in the drying process. The one difference between hair brush 1 and hair brush 20 is the root lifting tip 8 which is a continuation of bristles 21 located at the vertex top end of the hair brush 20.

Due to the unique shape of the cone brush head, different portions of hair are wrapped around a single area of the diameter and the resulting curls will vary, depending upon the diameter portion of the cone brush head onto which each part of hair is wound. For example, various curl sizes can be achieved by the use of this one present invention by simply wrapping the hair around a smaller or larger diameter of the cone brush head. The hair can start out having a small diameter, then progress to a larger diameter. Additionally, the hair can start out having a large diameter, then progress to a smaller diameter, then again to a smaller diameter. Thus, the use of the cone brush head provided the advantage of producing a helical curl with a continuum of differing diameters. Also, the cone brush head provides an unexpected advantage of a root lifter due to the small size diameter located at the vertex of the brush head. Root lifting can be achieved by selecting a portion of damp hair at the roots toughing the scalp and partially drying the hair before wrapping it around the diameter of choice, then blow drying the hair for rapid curl results.

Conventional hot-air brushes are unable to provide the advantages and/pr hair styling shapes and techniques obtained by using the cone brush head of the present invention. This is the result of the hair being wrapped around a cylindrical curler having a single diameter. Also there would be a need for multiple hairbrushes to produce similar curl diameters that this one present invention provides. Additionally, the unique shape of the cone brush head allows the hairbrush of the present invention to be used in a manner which cannot be duplicated using conventional, cylindrical brushes. For example, the cone brush head can provide small to large or even large to small size curls with a single lock or hair that achieves a unique spiral curl technique in one setting. While several preferred embodiments of this invention have been described in the specification and illustrated in the drawings with reference to the preferred embodiment, it is to be understood that this invention is not limited to these precise embodiments and that it will be understood by those skilled in the art that various changes may be made and equivalents may be substituted for elements thereof without departing from the scope or spirit of the invention as defined in the appended claims.

What is claimed is:

1. A hair brush comprising:

an elongate handle including a main body portion having an annular rim defining a circular recessed portion therein;

an elongate tube having a first end extending from an end of the handle and further including a second free end;

a plurality of disk-shaped members attached to said tube at spaced locations along the length thereof, one of the disk-shaped members defining a tapered docking station at the end of the tube adjacent the handle, each of the disk-shaped members further including a plurality of protruding nibs, the diameter of the disk-shaped members decreasing from the first to the second end of the tube;

a hollow head portion having a conical shape, said head portion including a plurality of bristles on an exterior surface thereof and further including a plurality of vent holes permitting air from a dryer to pass through the head and thus aiding in drying and shaping hair, each of the bristles having substantially the same length such that the free ends thereof define the same conical shape as the head portion, said head portion comprising:

a flat panel including a narrow top, a wide bottom and opposite tapered sides, the bottom of the panel including a plurality of tabs with each of the tabs including a hole, one of the sides of the panel including a plurality of protruding nibs and the opposite side including a plurality of holes, the protruding nibs on the one side of the panel engaging respective holes in the opposite side of the panel to secure the panel sides to each other and to form the flat panel into the conical shape, the holes in the tabs at the bottom of the panel engaged with respective protruding nibs of the tapered docking station, the protruding nibs of the other disk-shaped members engaged with respective holes in the flat panel intermediate the top and bottom thereof; and a retainer cap fixed to the second end of the hollow tube, said retainer cap having a rounded end portion and an annular step portion with a side wall of the retainer cap being substantially flush with the outer surface of the conical head portion.

* * * * *